US011035178B2

(12) United States Patent
Evans

(10) Patent No.: US 11,035,178 B2
(45) Date of Patent: Jun. 15, 2021

(54) APPARATUS AND METHODS FOR MOVING WORKOVER RIGS

(71) Applicant: James C. Evans, Englewood, CO (US)

(72) Inventor: James C. Evans, Englewood, CO (US)

( * ) Notice: Subject to any disclaimer, the term of this patent is extended or adjusted under 35 U.S.C. 154(b) by 0 days.

(21) Appl. No.: 16/586,331

(22) Filed: Sep. 27, 2019

(65) Prior Publication Data

US 2020/0018123 A1 Jan. 16, 2020

Related U.S. Application Data

(63) Continuation-in-part of application No. 16/511,964, filed on Jul. 15, 2019, now abandoned.

(60) Provisional application No. 62/697,619, filed on Jul. 13, 2018.

(51) Int. Cl.
*E21B 15/00* (2006.01)

(52) U.S. Cl.
CPC ..... *E21B 15/003* (2013.01)

(58) Field of Classification Search
CPC ..... E21B 7/02; E21B 15/003; B62D 57/02
See application file for complete search history.

(56) References Cited

U.S. PATENT DOCUMENTS 4,290,495 A * 9/1981 Elliston ..... E21B 7/02 166/77.4
8,925,658 B2 * 1/2015 Bryant ..... E21B 15/003 180/8.6
9,132,871 B2 * 9/2015 Crisp ..... B62D 57/02
9,168,962 B2 * 10/2015 Trevithick ..... E21B 15/003
9,518,429 B2 * 12/2016 Fortson ..... B62D 57/022
9,951,539 B2 * 4/2018 Roodenburg ..... E04H 12/187
10,472,009 B2 * 11/2019 Gupta ..... B62D 57/032
10,472,892 B1 * 11/2019 Conn, III ..... E21B 7/022
10,550,645 B1 * 2/2020 Ware ..... E21B 7/02
2003/0172599 A1 * 9/2003 Frink ..... E21B 15/003 52/116
2008/0237173 A1 * 10/2008 Altman ..... B63B 27/30 212/347
2009/0272540 A1 * 11/2009 Rodgers ..... E21B 19/00 166/377
2010/0038088 A1 * 2/2010 Springett ..... E21B 15/003 166/313
2012/0304553 A1 * 12/2012 Konduc ..... E04B 1/34384 52/112
2013/0343858 A1 * 12/2013 Flusche ..... E21B 19/155 414/800
2015/0053426 A1 * 2/2015 Smith ..... E21B 15/003 166/381

(Continued)

*Primary Examiner* — Benjamin F Fiorello
(74) *Attorney, Agent, or Firm* — Avant Law Group, LLC

(57) ABSTRACT

A transportation apparatus for moving a workover rig includes a first and a second pony substructure. A joist connects the first pony substructure to the second pony substructure. At least one stomper is operably connected to each of the first and second pony substructures for moving the transportation apparatus from a first location to a second location. The first and second pony substructures are configured to receive a vehicle that is configured as a workover rig. A proximal end of a first guide wire attaches to the walking structure, and a distal end of the guide wire attaches to the workover rig to stabilize the workover rig atop the transportation apparatus.

20 Claims, 4 Drawing Sheets

(56) References Cited

U.S. PATENT DOCUMENTS

| | | | | |
|---|---|---|---|---|
| 2015/0114717 | A1* | 4/2015 | Fortson | E21B 15/003 175/57 |
| 2015/0315861 | A1* | 11/2015 | Zachariasen | E21B 19/083 166/385 |
| 2016/0097238 | A1* | 4/2016 | Marek | B66C 23/80 248/188.3 |
| 2016/0186495 | A1* | 6/2016 | Flusche | B62D 57/032 180/8.6 |
| 2016/0280524 | A1* | 9/2016 | Crisp | B65G 7/00 |
| 2018/0163483 | A1* | 6/2018 | Ferland | E21B 15/003 |
| 2020/0055555 | A1* | 2/2020 | Williams | B66F 3/36 |
| 2020/0109603 | A1* | 4/2020 | Conn | E21B 15/003 |
| 2020/0240218 | A1* | 7/2020 | Miller | E21B 19/14 |

* cited by examiner

APPARATUS AND METHODS FOR MOVING WORKOVER RIGS

CROSS REFERENCE TO RELATED APPLICATIONS

This application is a continuation-in-part of U.S. patent application Ser. No. 16/511,964, filed Jul. 15, 2019, which is pending and which claims priority to U.S. Provisional Patent Application No. 62/697,619, filed Jul. 13, 2018, the entire disclosure of each of which is incorporated by reference herein in its entirety.

FIELD OF INVENTION

The disclosure relates generally to the field of oil rigs and well head maintenance. More specifically, the disclosure relates to workover rigs and systems and methods for moving the workover rigs.

SUMMARY

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

According to one embodiment, a transportation apparatus for moving a workover rig includes a first and a second pony substructure. A joist connects the first pony substructure to the second pony substructure. At least one stomper is operably connected to each of the first and second pony substructures for moving the transportation apparatus from a first location to a second location. The first and second pony substructures are configured to receive a vehicle that is configured as a workover rig. A proximal end of a first guide wire attaches to the walking structure, and a distal end of the guide wire attaches to the workover rig to stabilize the workover rig atop the transportation apparatus.

According to another embodiment, a transportable workover rig system includes a walking structure and a workover rig. The walking structure is formed by a pair of pony substructures, each substructure having a frame defining a platform, and each platform having a track. A plurality of joists secures together the pair of pony substructures, and a gap is defined between the respective pony substructures by the joists. A first stomper is disposed at a first end of the frame of each pony substructure, and a second stomper disposed at a second end of the frame of each pony substructure. A ramp is temporarily securable to the first end or the second end of the frame. The workover rig is configured as a vehicle having a plurality of laterally spaced apart wheels. A width of the gap between the respective pony substructures is substantially equal to or wider than a width of the laterally spaced apart wheels, and the workover rig is driven atop the respective platforms via the ramp and secured to the walking structure with at least one attachment mechanism. The walking structure is transported from a first location to a second location via the stompers when the workover rigs is secured to walking structure.

According to still another embodiment, method of servicing a plurality of oil and/or gas wells includes first providing a transportable walking structure. The transportable walking structure has a pair of pony substructures, each substructure having a frame defining a platform. A plurality of joists secures together the pair of pony substructures, and a gap is defined between the respective pony substructures by the joists. A first stomper is disposed at a first end of the frame of each pony substructure and a second stomper disposed at a second end of the frame of each pony substructure. The walking structure further includes a ramp that is temporarily securable to the first end or the second end of the respective frames of the respective pony substructures. The method continues by providing a workover rig configured as a vehicle having wheels. The ramp is secured to the pony substructures, and the workover rig is driven up the ramp to a position atop the respective platforms of the walking structure. The ramp is then detached from the pony substructures, the workover rig is secured to the walking structure, and rigged up. A first oil and/or gas well is serviced at the first location. Once the service of the first oil and/or gas well is completed, the walking structure is transported from the first location to a second location via the stompers, and the workover rig remains rigged up during transportation. A second oil and/or gas wall at the second location is subsequently serviced.

BRIEF DESCRIPTION OF THE FIGURES

Illustrative embodiments of the disclosure are described in detail below with reference to the attached drawing and figures, wherein.

DETAILED DESCRIPTION

Figure 1:
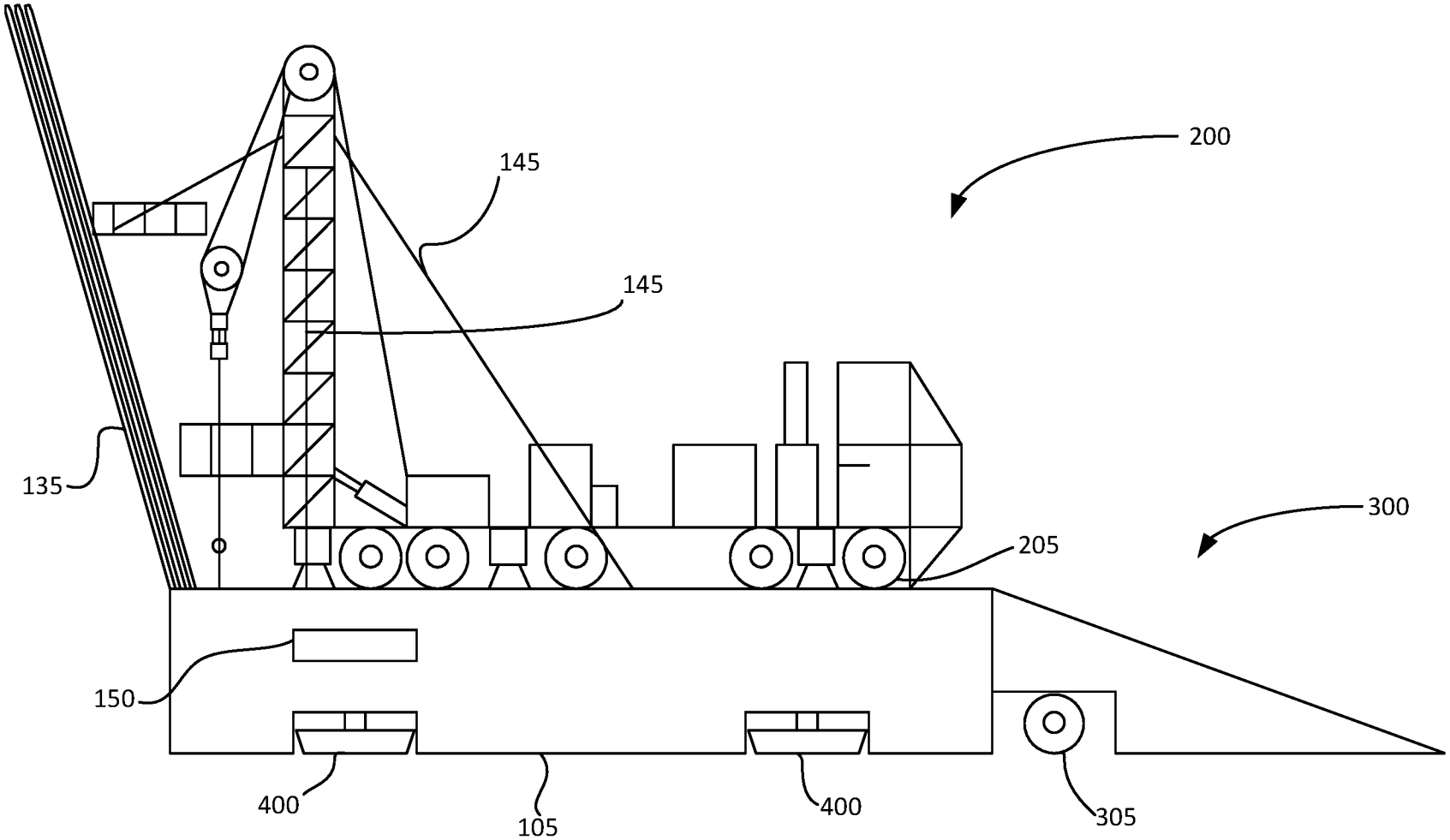
FIG. 1 is a side view of a structure for moving a workover rig and a workover rig.
Figure 2:
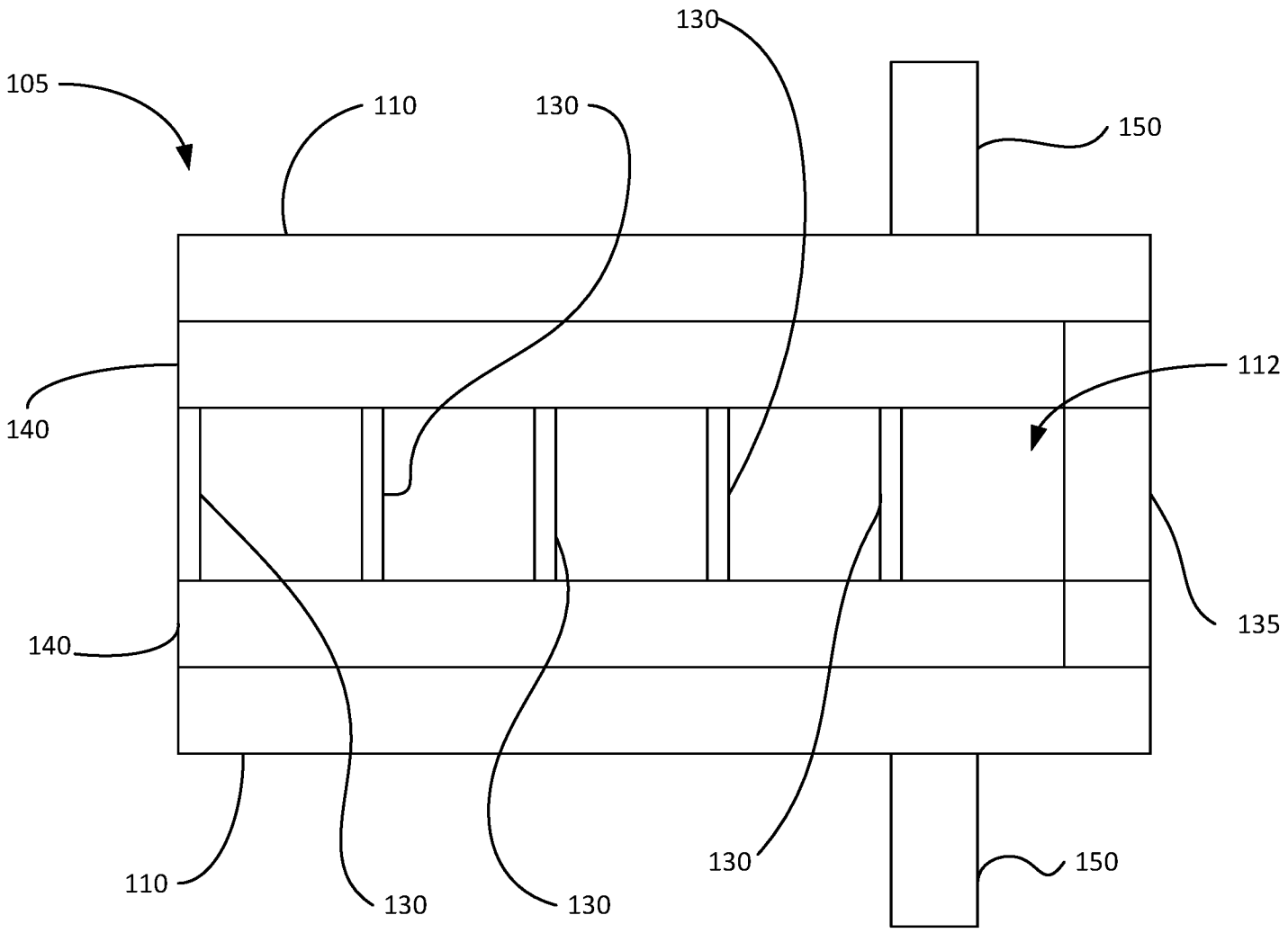
FIG. 2 is a top view of a structure for moving a workover rig.
Figure 3:
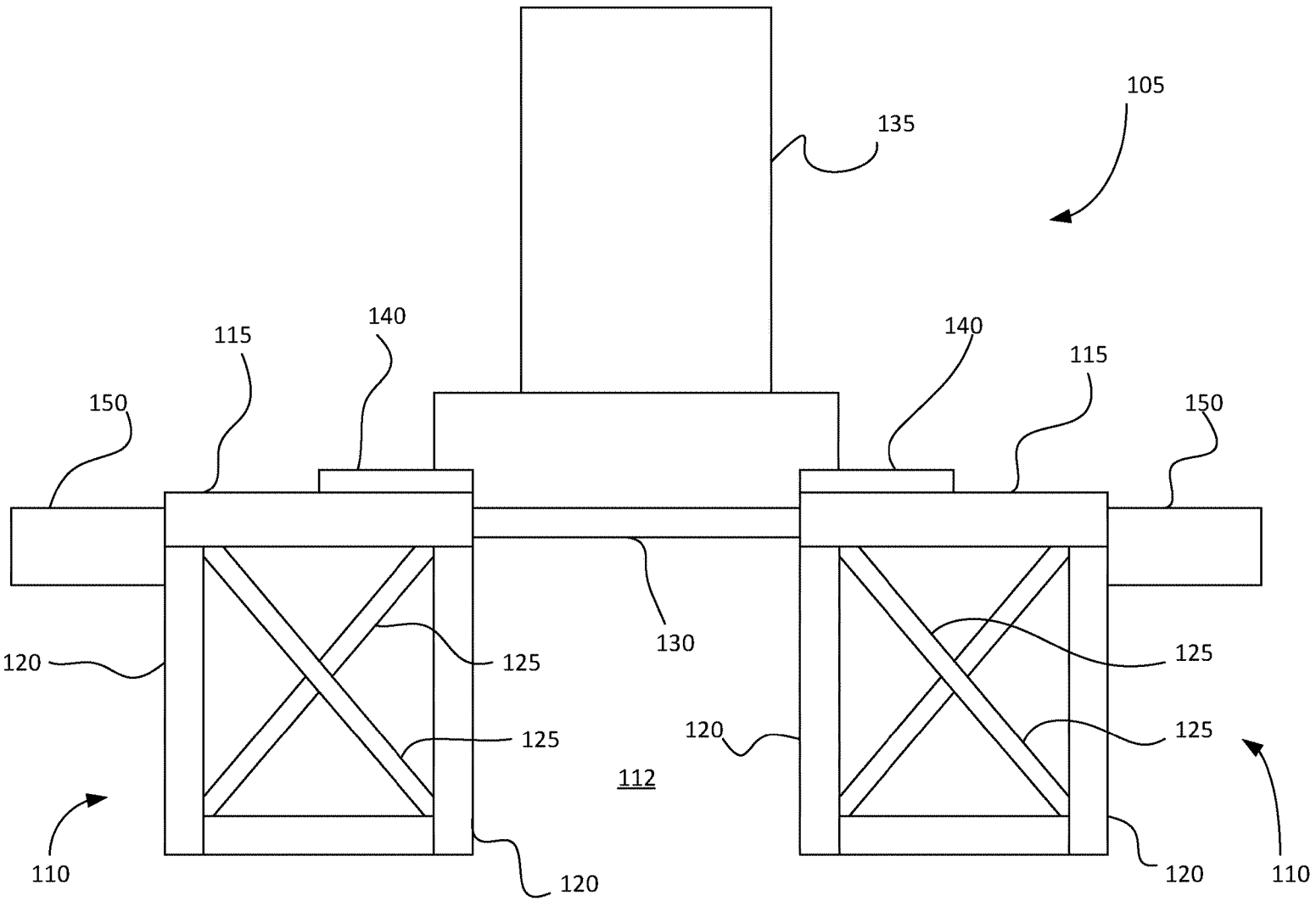
FIG. 3 is a back view of a structure for moving a workover rig.

Workover rigs are oil rigs that are set up at a well site for intervening with the oil well, including inserting or pulling pipe. Typically, a workover rig is rigged up at a first well site, the job is completed, and then the rig is rigged down and moved to a second well site. The process of setting up, and subsequently deconstructing, moving, and reconstructing the workover rig at a new location is time consuming and costly. Even where the workover rig is affixed to a vehicle, the rig must be rigged down before the workover rig can move from one location to another. This is both a dangerous and time-consuming task. Further, the workover rig 200 may only be rigged up and rigged down during daylight hours, resulting in limited operation times. Accordingly, systems that allow the workover rig to be maintained in its operational configuration when moving from one well location to another would be useful.

Embodiments of the invention include systems and methods for transporting a workover rig in its operational configuration. Broadly, the system 100 includes a superstructure 105 having two pony substructures 110 configured to selectively move a workover rig 200. The substructures 110 define a raised platform 115 supported by a plurality parallel frames 120.

The two generally parallel substructures 110 are operatively connected via one or more joists 130. The joists 130 connect at the innermost edge of each substructure's platform 115 and may, but need not, be substantially equally spaced along the length of the superstructure 105. In some embodiments the joists 130 are removable, and when not in use the joists 130 may be stored within the substructures 110. The joists 130 may be secured to the platforms 115 through the use of pins, latches, hydraulic hooks, et cetera. In some embodiments, the joists 130 may be welded or otherwise permanently secured between the respective platforms 115.

The joists 130 bridge a gap 112 defined between the two substructures 110. The gap 112 is configured to allow a well head to pass both under the platforms 115 and between the two substructures 110. Accordingly, in embodiments, the height of the platform 115 is greater than the height of the well head, and the width of the gap 112 is larger than the width of the well head. These dimensions allow the superstructure 105, when in motion, to pass over a well head without interference. A workover rig 200 may be generally centered over the gap 112 with two wheels 205 on each substructure 110, therefore, the width of the gap 112 must also allow for a workover rig 200 to bridge the gap 112. The ability to pass over well heads allows the superstructure 105 to move down a line of well heads without changing direction.

A fluctuating gap 112 width may lead to damage to the superstructure 105 or the well heads themselves. Preferably the joists 130 are strong enough to withstand any lateral forces that may exist between the two substructures 110. Accordingly, the joists 130 may maintain a substantially consistent gap 112 width during movement of the superstructure and operation of the workover rig 200.

A pipe rack 125 may be located at one end of the superstructure to provide the workover rig 200 with access to the necessary pipes for use during operation. The pipe rack 135 may be placed such that the pipes are stored either horizontally or vertically on the superstructure 105, and the pipe rack 135 can be refilled at any time. Further, the pipe rack 135 may be configured to carry pipes of any size. In some embodiments, the pipe rack 135 may be configured to hold 60-foot pipe, compared to the typical 30-foot length. The longer pipes may reduce the required pipe connections (and subsequent disassembles) that are required to complete the workover job for each well head nearly in half. Further, in some embodiments a pipe carousel may move the pipes from the pipe rack and provide them to the workover rig 200. As such, a standard derrick or stabbing board of a workover rig may be omitted. Each of the above listed features allows for more efficient tasks to be completed by the workover rig 200.

A pair of treads 140 may be positioned on the inside edge of platforms 115 on both pony substructures 110. The treads 140 provide traction to the tires 205 of the workover rig 200, and help the workover rig 200 maintain its position after setup and during operation. Further, detachable railings, stairs, and walkways may be secured to the superstructure to allow people to move around the superstructure 105. The railings, stairs, and walkways may be removed while the superstructure 105 is in motion, but it is not required.

A base beam is typically used to provide stability to the workover rig 200. The base beam is positioned at the base of and perpendicular to the workover rig 200, and is connected to the workover rig 200 through a series of guide wires. Here, the superstructure 105 replaces the base beam to provide support to the workover rig 200. The workover rig 200 may be secured to the superstructure 105 by a series of guidewires 145. When placed under tension, the guide wires 145 prevent the workover rig 200 from toppling over. The wires 145 may be secured to the superstructure 105 using clamps, hooks, latches, et cetera. Locking pins, hydraulic clamps, and/or other fastening mechanisms may alternately or additionally be used for securing the workover rig 200 to the superstructure 105; in this way, the amount of guide wires 145 may be significantly reduced or eliminated.

Wings 150 may extend laterally from the platform 115 of each pony substructure 110 to act as a base beam for the rig 200. During set up, the workover rig 200 may be secured to the superstructure 105 by extending guide wires 150 from the rig 200 to attachment apparatus at the wings 150, providing the needed stabilization. The wings 150 provide stabilization similarly to historical base beams, and will either meet or exceed current American Petroleum Institute (API) standards. The wings 150 may be configured to be removable and stored on the superstructure 105 when not in use. Additional platform anchors on the superstructure may provide areas to further secure the workover rig, replacing the ground anchors used at a traditional job site. The combination of the wings 150 and the platform anchors positioned on the superstructure 105, allows the workover rig 200 to be properly stabilized while only being attached to the superstructure 105.

By placing all the necessary securing points on the superstructure 105, it removes the need for the workover rig 200 to be attached to the ground, which allows the superstructure 105 to freely move without the need to rig down the workover rig 200 before moving to a new location. Additionally, the wings 150 remove the necessity for a base beam to extend through the gap 112 between the two substructures 110, thereby limiting any obstacles that may make contact with the wellhead during movement of the superstructure 105. The weight and size of the superstructure 105 will provide a sufficient base to absorb any forces the guide wires 145 may place on the superstructure 105.

The workover rig 200 may be placed onto the superstructure 105 using a method such as a crane. Alternately, in some embodiments, a removable ramp 300 may temporarily join with the superstructure 105 at an edge of the superstructure such that the workover rig 200 may be driven into position on the superstructure 105. The ramp 300 may have wheels 305 and a hitch to allow for a vehicle, such as a tractor, to position the ramp 300 at the superstructure 105. The height of the ramp 300 may be configured to level off at the height of the platforms 115, and the width of the ramp would be at least wide enough to accommodate the axle width of the workover rig 200. In embodiments, the ramp 300 is secured to the superstructure 105 using hydraulic hooks, pins, clamps, et cetera.

By placing the workover rig 200 onto the back of the moving superstructure 105, and securing the workover rig 200 to the superstructure 105, the workover rig 200 must only be set up a single time. This eliminates the requirement to rig up and rig down before moving onto the next well head. Further, the superstructure 105 may safely move 24 hours a day, meaning that the workover rig 200 can be operated during the entirety of the daylight hours and can be moved during the night. Greatly expanding the possible number of hours of operation.

In order to position the workover rig 200, the ramp 300 is first positioned at the superstructure 105 and may be secured to the superstructure 105 and/or the ground. Anchors or bearing supports may be attached to stabilize the ramp 300 while the workover rig 200 is positioned on the superstructure 105. As noted above, the workover rig 200 may be driven up the ramp 300 and into position on the superstructure 105. The ramp 300 is then taken away from the superstructure 105, and the workover rig 200 is rigged up for use. A similar process would be followed to remove the workover rig 200 from the superstructure 105.

In order to move and rotate the superstructure 105, a plurality of stompers 400 are positioned at the base of the substructures 110. Each stomper 400 includes a shoe 405, a horizontal hydraulic cylinder 410, a vertical hydraulic cylinder 415 operationally secured to the horizontal hydraulic cylinder 410 via an attachment 417, and may optionally further include a hydraulic rotary actuator 420 for altering the rotational position of the stompers 400. The plurality of stompers 400, when working in unison, can selectively lift, move, and rotate the superstructure 105. In addition to altering the vertical position of the superstructure 105, the vertical hydraulic cylinders 415 may be operable to ensure that the platforms 115 stay substantially level when the superstructure 105 moves from one location to another.

Figure 4:
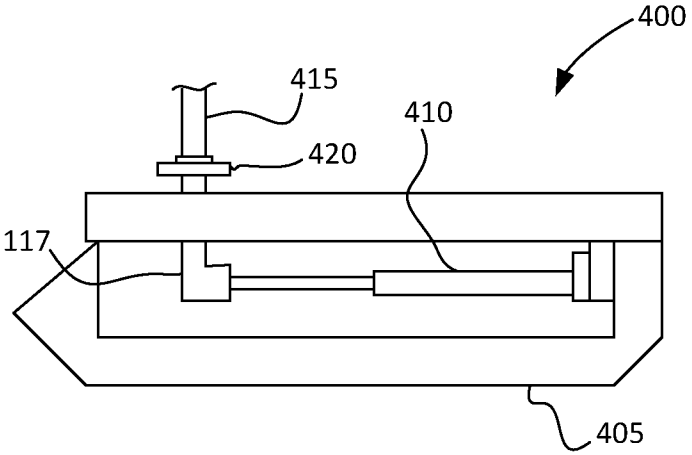
FIG. 4 is a side view of a stomper with an extended horizontal hydraulic cylinder.
Figure 5:
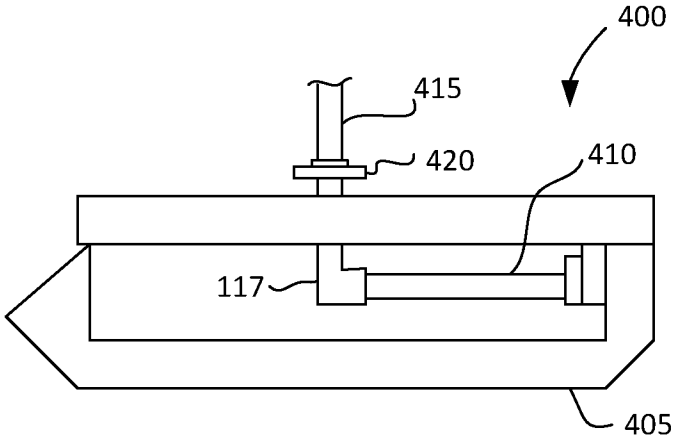
FIG. 5 is a side view of a stomper with a retracted horizontal hydraulic cylinder.

The process of moving the superstructure 105 starts with the substructures 110 engaging the ground with the stompers 400 retracted from the ground via the vertical hydraulic cylinder 415. Each stomper 400 is subsequently rotated towards a target direction using the hydraulic rotary actuator 415. Each stomper 400 may generally have the same target direction although slightly different target directions for one or more stompers 400 may be required to accomplish the desired movement. Next, the horizontal hydraulic cylinders 410 are retracted to "load" the stompers 400, or to prepare the stompers 400 to move the superstructure 105. As shown in FIG. 5, in the retracted position, the attachment 417 (and therefore the vertical hydraulic cylinder 415) is at a first retracted position relative to the length of the stomper 400. The vertical cylinders 415 are extended, placing the shoes 405 on the ground. The pressure in the vertical cylinders 415 is sufficient to lift the superstructure 105 off the ground. Once the superstructure 105 is completely off the ground, the horizontal hydraulic cylinders 410 extend, as shown in FIG. 4, "unloading" the cylinders, or moving the superstructure 405 axially along the horizontal axis of the horizontal hydraulic cylinders 410 to a second extended position. Finally, the vertical hydraulic cylinders 415 are retracted, lifting the stomper 405 off the ground, and placing the superstructure 105 back on the ground. The process can be repeated to continue movement of the superstructure 105. To rotate the superstructure 105, the hydraulic rotary actuators 420 may rotate the position of the stomper 400 when the stomper 400 is retracted from the ground. Because the stomper 400 moves along the horizontal axis defined by the horizontal hydraulic actuator 410, when the stomper 400 is rotated, the superstructure 105 will move according to the rotation of the stomper 400.

Typically, the stompers 400 operate in unison, however, the stompers 400 may also work independently. The independent functionality may be specifically helpful when the ground is uneven. The stompers 400 may be capable of measuring and maintaining a level platform 115 when the superstructure 105 is in motion or when the superstructure 105 is fixed. For example, in certain circumstances the ground may be so uneven that in order to maintain a level platform 115 the individual vertical hydraulic cylinders 415 on some stompers 400 may have to lift the superstructure off the ground despite not being in motion in order to level the platform 115.

The stompers 400 may be operated by a hydraulic system as is known in the art. In some embodiments this system is located entirely on the superstructure 105 and, in some embodiments, can be powered by a diesel engine, an electric turbine, or any other power source now known or later developed. So, for example, a diesel engine may be incorporated into a pony substructure 110 or another portion of the superstructure 105. Further, the stompers 400 may be remote-controlled, allowing for the operator to be a safe distance from the superstructure 105. In some embodiments, a manual control panel may be located on the superstructure 105 alternately, or in addition to the remote control (e.g., in the event of a failure of the remote control).

Eventually, the superstructure 105 will move into position over a well head. The proper location of the well head with respect to the superstructure 105 will depend on the position of the workover rig 200 on the superstructure 105. In some embodiments, the well head will be positioned at or near one end of the superstructure 105. After reaching the intended position, the workover rig 200 will be able access the well head through the gap 112 in the pony substructures 110.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A transportation apparatus for moving a workover rig, comprising:

a first and a second pony substructure;

a joist connecting the first pony substructure to the second pony substructure; and at least one stomper operably connected to each of the first and second pony substructures for moving the transportation apparatus from a first location to a second location;

wherein:

the first and second pony substructures are configured to receive a vehicle, wherein the vehicle comprises a workover rig;

a proximal end of a first guide wire attaches to the walking structure and a distal end of the guide wire attaches to the workover rig thereby stabilizing the workover rig atop the transportation apparatus.

2. The transportation apparatus of claim 1, further comprising a ramp removably coupled to the first and second pony substructures to allow the vehicle to drive onto the respective pony substructures.

3. The transportation apparatus of claim 1, further comprising a wing extending perpendicularly from at least one of the first and second pony substructures.

4. The transportation apparatus of claim 3, wherein a proximal end of a second guide wire attaches to the wing for further stabilizing the workover rig atop the transportation apparatus.

5. The transportation apparatus of claim 4, wherein each stomper comprises a horizontally mounted hydraulic cylinder for moving the transportation apparatus along an axis of the horizontally mounted hydraulic cylinder.

6. The transportation apparatus of claim 5, wherein each stomper further comprises a vertically mounted hydraulic cylinder for moving the transportation apparatus along an axis of the vertically mounted hydraulic cylinder, and wherein the vertically mounted hydraulic cylinder is attached to the horizontally mounted hydraulic cylinder.

7. The transportation apparatus of claim 1, wherein each of the first and second pony substructures comprises a track, and wherein wheels of the vehicle engage with the respective tracks when atop the transportation apparatus.

8. The transportation apparatus of claim 1, wherein each of the stompers is individually controllable.

9. The transportation apparatus of claim 1, further comprising a pipe rack.

10. The transportation apparatus of claim 9, wherein the pipe rack is configured to hold pipes having a length of up to 60 feet.

11. A transportable workover rig system, comprising:

a walking structure, comprising:

a pair of pony substructures, each substructure comprising a frame defining a platform, each platform having a track;

a plurality of joists securing together the pair of pony substructures, wherein a gap is defined between the respective pony substructures;

a first stomper disposed at a first end of the frame of each pony substructure and a second stomper disposed at a second end of the frame of each pony substructure; and a ramp temporarily securable to the first end or the second end of the frame;

a workover rig configured as a vehicle having a plurality of laterally spaced apart wheels;

wherein:

a width of the gap between the respective pony substructures is at least as large as a width of the laterally spaced apart wheels;

the workover rig is driven atop the respective platforms via the ramp and secured to the walking structure with at least one attachment mechanism; and the walking structure is transported from a first location to a second location via the stompers when the workover rigs is secured to walking structure.

12. The system of claim 11, wherein the attachment mechanism is at least one of a tie rod, a locking pin, a latch, and a hydraulic clamp.

13. The system of claim 11, wherein the walking structure further comprises a pipe rack configured to store a section of pipe having a length of up to 60 feet.

14. The system of claim 11, wherein the stomper comprises a horizontally mounted hydraulic cylinder for moving the walking structure along an axis of the horizontally mounted hydraulic cylinder.

15. The system of claim 14, wherein the stomper further comprises a vertically mounted hydraulic cylinder, wherein a proximal end of the vertically mounted hydraulic cylinder is attached to a distal end of the horizontally mounted cylinder, and a distal end of the vertically mounted hydraulic cylinder is attached to the walking structure thereby securing the stomper thereto.

16. The system of claim 15, wherein the stomper further comprises a hydraulic rotary actuator, and wherein the stomper rotates about an angle of rotation via the hydraulic rotary actuator.

17. The system of 16, wherein the horizontally mounted hydraulic cylinder, the vertically mounted hydraulic cylinder, and the hydraulic rotary actuator are remote controlled.

18. The system of claim 15, wherein power to the respective hydraulic cylinders is integral to the walking structure.

19. The system of claim 14, wherein the horizontally mounted hydraulic cylinder and the vertically mounted hydraulic cylinder are remote controlled.

20. A method of servicing a plurality of oil and/or gas wells, comprising:

providing a transportable walking structure at a first location, the walking structure comprising:

a pair of pony substructures, each substructure comprising a frame defining a platform;

a plurality of joists securing together the pair of pony substructures, wherein a gap is defined between the respective pony substructures;

a first stomper disposed at a first end of the frame of each pony substructure and a second stomper disposed at a second end of the frame of each pony substructure; and a ramp temporarily securable to the first end or the second end of the respective frames of the respective pony substructures;

providing a workover rig configured as a vehicle having wheels;

securing the ramp to the pony substructures;

driving the workover rig up the ramp to a position atop the respective platforms of the walking structure;

detaching the ramp from the pony substructures;

securing the workover rig to the walking structure;

rigging up the workover rig;

servicing a first oil and/or gas well at the first location;

transporting the walking structure from the first location to a second location via the stompers, wherein the workover rig remains rigged up during transportation;

servicing a second oil and/or gas well at the second location.

* * * * *